US005653616A

United States Patent [19]

Hotea

[11] Patent Number: 5,653,616

[45] Date of Patent: Aug. 5, 1997

[54] ELECTRICAL RECEPTACLE TERMINAL

[75] Inventor: Gheorghe Hotea, Griesheim, Germany

[73] Assignee: The Whitaker Corporation, Wilmington, Del.

[21] Appl. No.: 458,065

[22] Filed: Jun. 2, 1995

[30] Foreign Application Priority Data

Jun. 13, 1994 [DE] Germany ..... 94 11 809.8

[51] Int. Cl.[6] ..... H01R 11/22

[52] U.S. Cl. ..... 439/851; 439/852; 29/882

[58] Field of Search ..... 439/856, 857, 439/399, 401, 852, 851, 861; 29/874, 882

[56] References Cited

U.S. PATENT DOCUMENTS

| | | | |
|---|---|---|---|
| 3,713,079 | 1/1973 | Dechelette . | |
| 3,729,701 | 4/1973 | Smith . | |
| 4,385,794 | 5/1983 | Lucius . | |
| 4,540,235 | 9/1985 | Lolic . | |
| 4,734,064 | 3/1988 | Knapp et al. | 439/856 X |
| 4,907,990 | 3/1990 | Bertho et al. . | |
| 4,952,178 | 8/1990 | Beer | 439/856 |
| 5,007,865 | 4/1991 | Jakobeit | 439/856 X |
| 5,295,875 | 3/1994 | McCardell | 439/856 X |
| 5,376,012 | 12/1994 | Clark | 439/857 X |

FOREIGN PATENT DOCUMENTS

| | | |
|---|---|---|
| 0 352 871 | 12/1985 | European Pat. Off. . |
| 0 517 139 A2 | 12/1992 | European Pat. Off. . |
| 0 517 076 A2 | 12/1992 | European Pat. Off. . |
| 0 517 077 A2 | 12/1992 | European Pat. Off. . |
| 2 407 063 | 2/1974 | Germany . |
| 2914242 | 10/1979 | Germany . |

*Primary Examiner*—David L. Pirlot
*Assistant Examiner*—Christopher J. McDonald

[57] ABSTRACT

A receptacle terminal having a receptacle end for receiving a pin terminal, the receptacle end including a body portion from which opposed contact walls extend between similarly extending strut walls, the walls forming a forwardly disposed shroud portion where the contact walls are connected to adjacent strut walls. A cantilevered contact arm for engaging the pin terminal is struck from one of the contact walls, leaving an opening therein having a tab formed along one of the strut walls. The contact wall being deformed to bring the tab over the contact arm, whereby deflection of the contact arm is opposed by the strut wall providing increased strength.

11 Claims, 3 Drawing Sheets

10
14
12
4
8
2
22
20
18
24
32
28
30
38
6
64
46
42
48
50
50
60
66
26
62
68
56
40
4

10
14
14
4
12
12
18
18
8
20
20
24
36
32
38
6
2
30
34
34
38
30
64
78
78
64
46
46
50
42
52
52
50
72
72
76
76
40
40
26
74
44
54
58
5
5
6
6

ELECTRICAL RECEPTACLE TERMINAL

BACKGROUND OF THE INVENTION

1. Field of the Invention

This invention relates to an electrical receptacle terminal for connecting with pin terminals.

2. Description of the Prior Art

In order to interconnect electrical components, the pin terminal-receptacle terminal interface has been widely accepted in industry. The pin terminals are elongate members having a suitable cross-section, for example circular, rectangular, or square, for electrical engagement by a receptacle terminal. Typical receptacle terminals have a contact surface disposed along a resilient contact arm such that when the pin terminal is inserted therein, the contact surface interferes with the pin terminal to form an electrical engagement therewith. It is desirable that the receptacle terminal present a minimal amount of insertion force resistance while still providing sufficient normal force so that the interference with the pin terminal is sufficient to establish a reliable interconnection.

A known pin receptacle terminal incorporates at least one cantilevered contact arm having a contact surface thereal-ong. In a receptacle terminal of this type there is a direct trade-off between the insertion force and the normal force exerted upon a mating pin terminal. This trade-off is a result of both characteristics being dependant upon the spring deflection characteristics of the contact arm.

U.S. Pat. No. 4,385,794 discloses a receptacle terminal having a box-like pin socket that includes a cantilevered contact arm having a contact surface thereupon for electrically engaging a pin terminal received within the socket. The contact arm is cantilevered from a wall at the front of the socket to a free end that is rearward therefrom as defined along the direction of insertion of the pin terminal. The cantilevered contact arm is bent into the socket so that the contact surface will engage the inserted pin terminal. A pressing is provided along the receptacle, corresponding to the free end of the contact arm to prevent over-stressing. As the contact arm extends from the cantilevered point in the direction of insertion of the pin terminal, stubbing of the pin terminal against the contact arm is not a problem. However, a disadvantage of this design is the relatively late engagement of the pin terminal by the contact arm as the contact surface upon the contact arm is located towards the rear of the receptacle, thereby limiting the amount of wiping engagement that may occur.

SUMMARY OF THE INVENTION

It is an object of the present invention to provide an improved receptacle terminal.

It is another object of this invention to have a receptacle terminal having a contact arm with a relatively low insertion force and a relatively high normal force.

It is yet another object of this invention to produce the terminal from a single piece.

These and other objects are accomplished by providing a receptacle terminal comprising a receptacle end for receiving a pin terminal, the receptacle end including a body portion from which a contact arm extends between similarly extending transversely disposed strut walls, the walls forming interconnected to form a forwardly disposed shroud portion therein characterized in that a tab is formed along one of the strut walls, the strut walls being deformed to bring the tab over the contact arm, whereby deflection of the contact arm is opposed by the strut wall.

DETAILED DESCRIPTION OF THE PREFERRED EMBODIMENT

Figure 1:
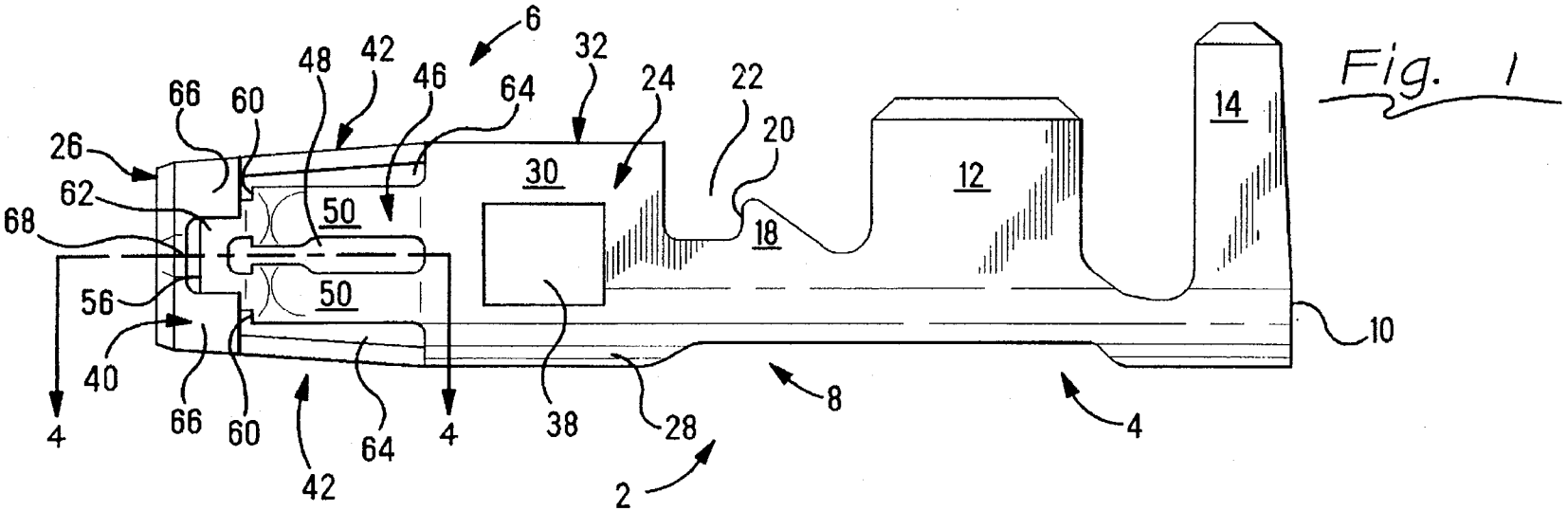
FIG. 1 is a side view of a receptacle terminal according to the present invention.
Figure 2:
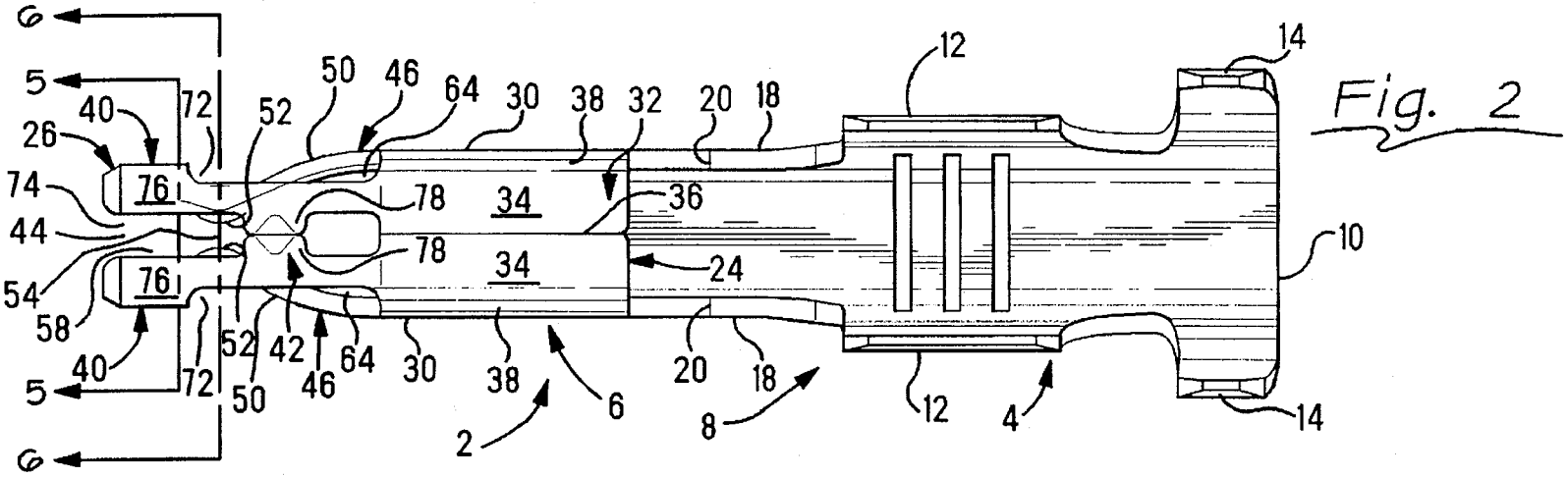
FIG. 2 is a top view of the receptacle terminal of FIG. 1.

Referring to FIGS. 1 and 2, a receptacle terminal is shown generally at 2. The receptacle terminal 2 comprises a conductor engaging end 4 and a receptacle end 6 with an intermediate portion 8 therebetween. In this embodiment, the conductor engaging end 4 is constructed for crimpably attaching the receptacle terminal 2 to an insulated conductor, such as a conventional wire (not shown). This structure includes a U-shaped base 10 from which a pair of conductor engaging crimp tabs 12 and a pair of insulation engaging strain relief arms 14 extend in an opposing U-shaped manner. An insulated conductive wire having a portion of the insulation stripped therefrom is placed within the conductor engaging end 4 so that the exposed conductor corresponds to the conductor engaging crimp arms 12 while an insulation coated portion is disposed between the insulation engaging strain relief arms 14. By crimping the conductor engaging crimp tabs 12 over upon the conductor, the receptacle terminal 2 is electrically connected thereto. The insulation engaging strain relief arms 14 are crimped to tightly engage the insulation surrounding the conductor to provide strain relief for the electrical connection. This is just one possible configuration for the conductor engaging end 4 which could rather be configured as an insulation displacement contact, a pin-like structure for engaging a circuit trace on a printed circuit board, a receptacle terminal for engaging a mating tab terminal, or any other structure that functions to electrically engage a conductor.

The conductor engaging end 4 is connected to the receptacle end 6 of the receptacle terminal 2 by way of an intermediate portion 8 is a continuation of the U-shaped base 10. Extending upward along the legs of the U-shaped base 10 are barbs 18 having a forwardly disposed bearing surface 20. The bearing surface 20 and the receptacle terminal 6 form a region 22 therebetween. This region 22 is useful for receiving a secondary locking member (not shown) of an electrical connector housing (not shown) in order to assure the receptacle terminal 2 is positively retained within the connector housing. Incorporation of the region 22 into the receptacle terminal 2 for receiving a secondary locking member makes this receptacle terminal 2 especially useful for incorporation into electrical connectors used in high vibration environments, for example vehicles.

The receptacle end 6 includes a body portion 24 and a shroud portion 26. The body portion 24 includes a base 28 and two opposing upstanding sides 30. The base 24 and upstanding sides 30 are contiguous with the intermediate portion 8 and the conductor engaging end 4. In this embodiment, a top 32 opposite the base 28 is formed by over-folded tab extensions 34 from sides 30 which meet along seam 36. The tab extensions 34 may be joined along seam 36 by welding or interlocking mechanical features. By joining the tabs 34 along seam 36 a robust tubular section is formed. However, it may not be necessary to join the tabs 34 together, it may also be desirable to incorporate only a single tab 34 spanning the upstanding legs 30 to be joined to the opposing upstanding side 30. Ports 38 are included in the body portion 24 to retain the contact within a connector housing (not shown). In this embodiment, these ports 38 are aligned openings in the opposing upstanding sides 30. Locking lances may also be struck from the body portion 24 in place of the ports 38 to retain the contact.

Contact support walls 40 are located forwardly from the body portion 24 between similarly extending strut walls 42. The contact walls 40 are connected to adjacent strut walls 42 at a forwardly disposed shroud portion 26. The shroud portion 26 defining an opening 44 for receiving a pin terminal (not shown). Forwardly extending cantilevered contact arms 46 are struck from each of the opposing contact support walls 40. Each contact arm 46 is similarly configured and includes an elongate opening 48 that defines a pair of contact beams 50. As this embodiment is constructed for engaging a tab terminal having a rectangular cross-section, the opening 48 provides some compliance between the adjacent contact beams 50, thereby assuring an interconnection even with a misaligned terminal.

The contact arms 46 include contact surfaces 52 that define a contact receiving region 54 therebetween that is in communication with the opening 44 in the shroud portion 26. Forward of contact surfaces 52, the contact arms 46 diverge to free ends 56 for easy insertion of the pin terminal. The free ends 56 of the contact arms 46 include shoulders 60 from which a central tongue 62 extends. To further separate the contact arms 46 from the contact support walls 40 and strut walls 42, openings 64 may be formed on opposite sides of contact beams 50. The openings 64 may further extend over into strut walls 42, as shown in FIG. 2 and FIG. 7.

Figure 6:
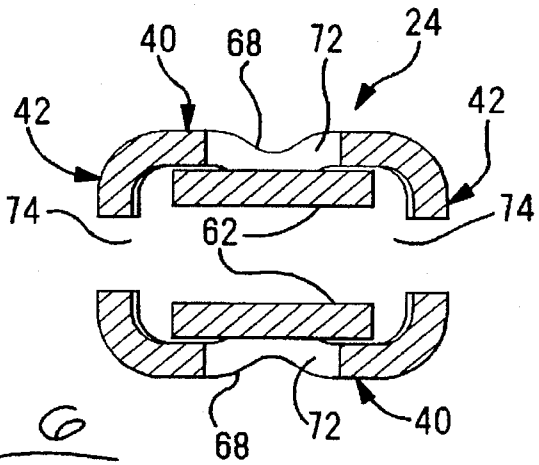
FIG. 6 is a sectional view taken along lines 6—6 of FIG. 2.
Figure 5:
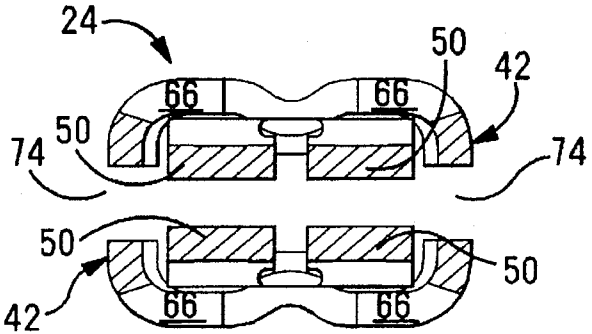
FIG. 5 is a sectional view taken along lines 5—5 of FIG. 2.
Figure 4:
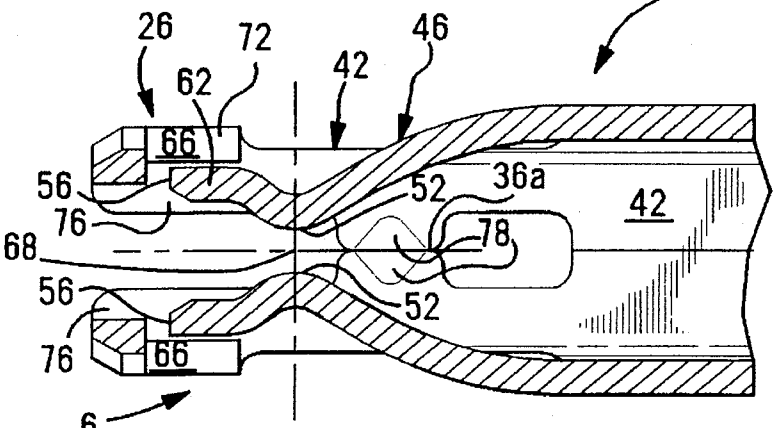
FIG. 4 is a sectional view taken along lines 4—4 of the receptacle terminal of FIG. 1.

As seen in FIG. 1, the contact support walls 40 include a pair of tabs 66 that are connected to strut walls 42, as described below, and are interconnected by a portion 68 of the contact wall 40. These tabs 66 overlie the contact arm 46 so that the deflection of the contact arms 46 can be opposed by the strut walls 42, as seen in FIG. 5 and FIG. 6.

Figure 7:
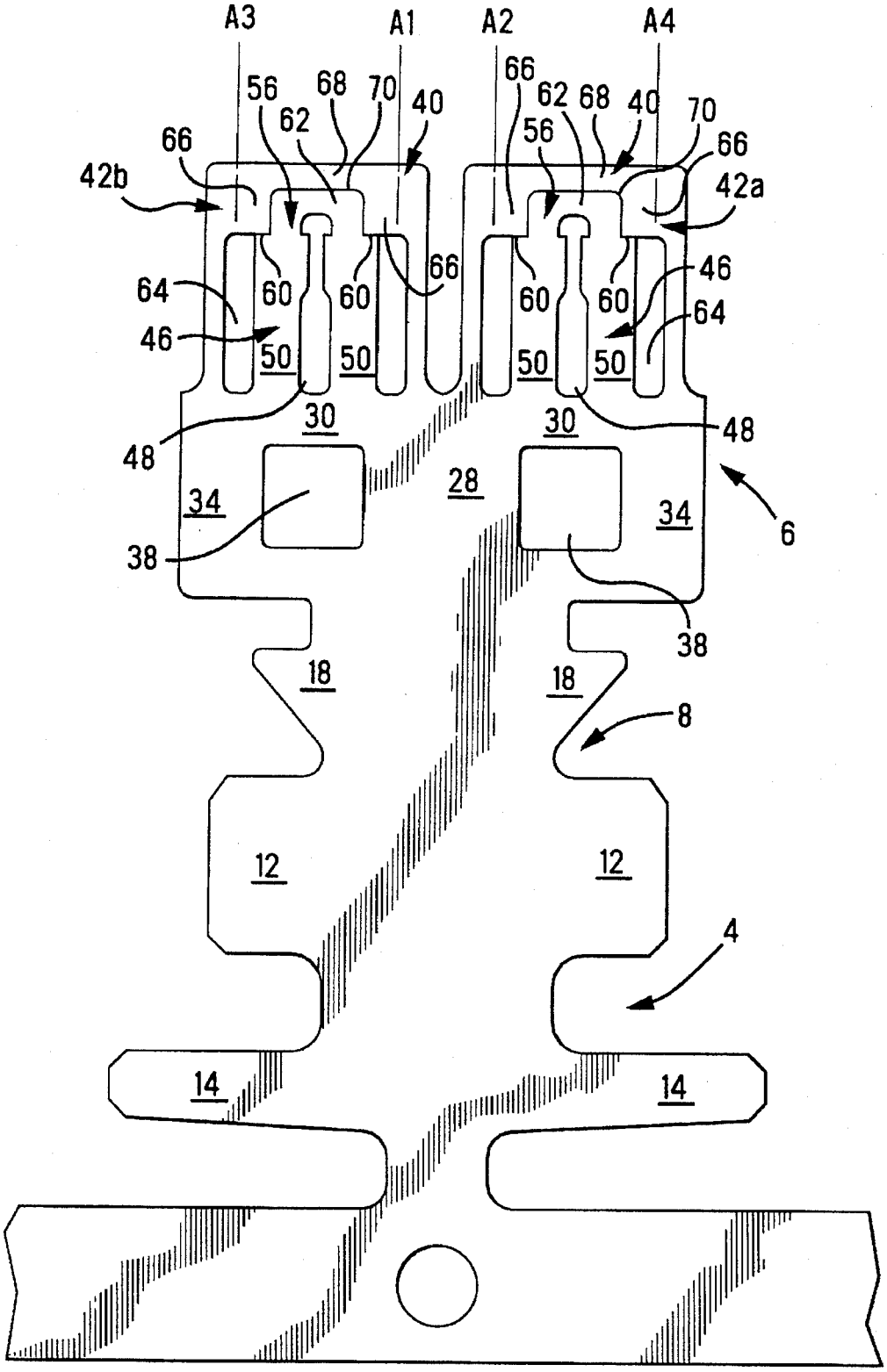
FIG. 7 is a plan view of the terminal blank used to form the receptacle terminal of FIG. 1.

With reference now to FIG. 7, the tabs 66 are formed when the contact arm 46 is struck from contact support wall 40. A sheer line 70 separates the free end 56 of the contact arm 46 from the contact support wall 40. The sheer line 70 lies along the tabs 66 of the contact wall 40 at the shroud portion 26, the shoulder 60 and the tongue. When the contact arms 46 are stamped and formed, an opening 72 is created. This opening 72 corresponds to the size and shape of the contact arm 46 and the opening 72 may be supplemented by the longitudinal openings 64 that lie therealong.

Returning to FIG. 1 and FIG. 2, the strut walls 42 extend along the sides of the contact walls 40 and are interconnected at the shroud portion 26 through the contact support walls 40. The strut walls 42 are transverse to the contact arms 46. As the tab 66 overlies the tongue 62 of the contact arms 46 insertion of a pin terminal into the contact receiving region 54 will bias the cantilevered contact arms 46 apart. As the cantilevered contact arms 46 move apart, the tongue 62 abuts the tabs 66 which are connected to the strut walls 42. This enables the strut wall 42 to support the contact arm 46, thereby increasing the normal force exerted by the contact arms 46 upon the pin terminal beyond what would be possible with an unsupported contact arm 46. The amount of resilience offered by these strut walls 42 may be "tuned" by including a separating slot 74 extending inward along the strut wall 42. This separating slot 74 acts to cantilever the front portions 76 of the strut walls 42 at the shroud portion 26. In the case of FIG. 2, where the strut wall 42 is formed integrally with tab extensions 34, it may be desirable to provide joining tabs 78 which when abutted define seam **36*a*** and enable further connection, for example, by welding.

As shown in FIG. 1, in order for the tab 66 to overlie the tongue 62 the strut walls 42 converge inwardly from the body portion 24 to the shroud portion 26. It may be possible to incorporate parallel strut walls 42 if the strut walls are initially deflected where they extend from the body portion 24, thereby enabling the front of the terminal 2 to present a reduced profile.

Figure 3:
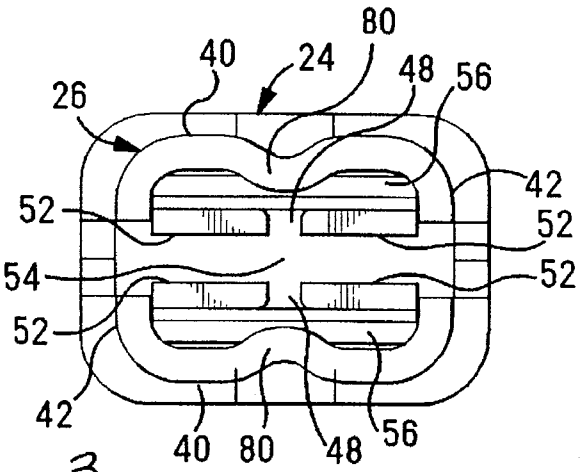
FIG. 3 is a front view of the receptacle terminal of FIG. 1.

In order to bring the tabs 66 inward, thereby reducing the size of the opening 72 from which the contact arm 46 was struck, the portion of the contact support wall 68 between the tab 66 at the shroud portion 26 is deformed by forming a buckle 80, best seen in FIG. 3. Advantageously, the buckle 80 is disposed into opening 44 at the shroud portion 46 and extends downward in front of the free ends 56 of the contact arms 46, thereby offering the contact arms 46 some protection against stubbing by the mating pin terminal.

In order to manufacture a receptacle terminal 2 of the type described above, it is necessary to first form a terminal blank 90, shown in FIG. 7. The terminal blank 90 having the same reference numbers as those reference numbers of the aforedescribed receptacle terminal 2. Once the terminal blank 90 is formed, the cantilevered contact arm 46 is struck from one of the contact arms 40 of the terminal blank. This leaves tab 66 connected to one of the strut walls 42. The strut walls 42 are then moved inward to bring the tab 66 above the contact arm 46. The terminal blank 90 can then be folded along lines A1 and A2 to form a strut wall therebetween and A3 and A4 to form the contact walls between folds A1 and A3 and A2 and A4 respectively. Strut wall portions **42*a* and 42*b* then abut each other to form the seam 36 and the final strut wall 42. In order to bring the tab 66 over the contact arm 46, the contact walls 40 may be buckled at the front portion 68 of the contact wall 40. The buckling acting to shorten the distance between the strut walls 42**.

Advantageously then, an electrical receptacle terminal 2 is created having a freely cantilevered contact arm 46 that may except a pin terminal with minimal insertion force and which is backed up by a strut wall 42 to provide increased normal forces. Furthermore, the receptacle terminal 2 may be manufactured from a single terminal blank.

We claim:

1. A receptacle terminal comprising a receptacle end for receiving a terminal, the receptacle end including a body portion from which a contact arm extends between similarly extending transversely disposed strut walls, the walls being interconnected to form a forwardly disposed shroud portion the terminal being characterized in that a tab is formed in communication with the strut walls, the strut walls being deformed to create a buckle in the shroud to bring the tab over the contact arm, whereby deflection of the contact arm as the terminal is inserted is opposed by the strut wall.

2. The receptacle terminal of claim 1, characterized in that contact arms are struck from a support wall of the shroud, wherein the tab is part of the shroud.

3. The receptacle terminal of claim 1, characterized in that a pair of spaced apart tabs are formed to support the contact arm.

4. The receptacle terminal of claim 1, characterized in that the strut walls are closer together at the shroud portion than at the body portion.

5. The receptacle terminal of claim 1, characterized in that the contact arm has a free end that includes a tongue extending therefrom and the tab overlies the tongue, where an edge of the tab corresponded to a edge of the tongue before forming.

6. The receptacle terminal of claim 3, characterized in that a free end of the contact arm is struck from the shroud portion where the contact support wall is buckled bringing that portion of the contact support wall located at the shroud portion adjacent to where the free end is struck over the free end of the contact arm as the tab, whereby as the adjacent strut walls cooperate with the contact support wall at the shroud portion to oppose displacement of the free end of the contact arm.

7. The receptacle terminal of claim 1, characterized in that the contact arm is formed to have a free end closely disposed to the tab prior to insertion of the pin terminal.

8. The receptacle terminal of claim 1, characterized in that the buckle is disposed in front of the free end of the contact arm.

9. A receptacle terminal comprising a receptacle end for receiving a pin terminal, the receptacle end including a body portion from which opposed contact walls extend between similarly extending strut walls, the contact walls and the strut walls forming a forwardly disposed shroud portion were the contact walls are connected to adjacent strut walls, and a cantilevered contact arm for engaging the pin terminal being struck from one of the contact walls and leaving an opening therein characterized in that a tab is formed along one of the strut walls and the strut walls are closer together at the shroud than at the body portion so that the tab overlies the contact arm, whereby deflection of the contact arm is opposed by the strut wall.

10. A method of manufacturing a receptacle terminal; comprising the steps of:

(a) forming a terminal blank having a body portion from which a pair of contact walls extend forwardly, with strut walls running therealong, to a,forwardly disposed shroud portion and (b) folding the terminal blank into a receptacle terminal with the contact walls oriented in an opposing manner and extending forwardly with the strut walls running therealong;

where between the steps of forming and folding the method is characterized by the steps of:

(c) striking a cantilevered contact arm from one of the contact walls of the terminal blank;

(d) forming a tab connected to one of the strut walls of the terminal blank; and (e) bending the strut wall inward to bring the tab over the contact arm.

11. The method of claim 10, characterized in that the bending of the strut walls is accomplished by buckling the contact wall.

* * * * *